US010985499B2

(12) United States Patent
Miyamoto et al.

(10) Patent No.: US 10,985,499 B2
(45) Date of Patent: Apr. 20, 2021

(54) ELECTRIC CONNECTOR

(71) Applicant: KYOCERA CORPORATION, Kyoto (JP)

(72) Inventors: Kenji Miyamoto, Yokohama (JP); Munenobu Yoshida, Yamato (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/615,583

(22) PCT Filed: Apr. 25, 2018

(86) PCT No.: PCT/JP2018/016873
§ 371 (c)(1),
(2) Date: Nov. 21, 2019

(87) PCT Pub. No.: WO2018/221095
PCT Pub. Date: Dec. 6, 2018

(65) Prior Publication Data

US 2020/0091654 A1 Mar. 19, 2020

(30) Foreign Application Priority Data

May 29, 2017 (JP) ..... JP2017-105959

(51) Int. Cl.
*H01R 13/62* (2006.01)
*H01R 13/627* (2006.01)
*H01R 12/71* (2011.01)

(52) U.S. Cl.
CPC ..... *H01R 13/6273* (2013.01); *H01R 12/716* (2013.01)

(58) Field of Classification Search
CPC ..... H01R 13/6273; H01R 12/716
(Continued)

(56) References Cited

U.S. PATENT DOCUMENTS 8,083,527 B2 * 12/2011 Takeuchi ..... H01R 12/716 439/65
8,257,095 B2 * 9/2012 Akai ..... H01R 13/6315 439/74

(Continued)

FOREIGN PATENT DOCUMENTS

JP 2006012625 A 1/2006
JP 2006210206 A 8/2006

(Continued)

*Primary Examiner* — Alexander Gilman
(74) *Attorney, Agent, or Firm* — Duane Morris LLP

(57) ABSTRACT

Provided is an electric connector capable of preventing damage to a housing and deformation of a bracket even if it is miniaturized. An electric connector (10) according to the present disclosure includes: a first connector (20) having a first housing (30) with a recess (35) formed in a first surface and a first bracket (54) held by the first housing (30) while facing the first surface; and a second connector (60) fitted with the first connector (20), the second connector having a second housing (70) with a projection (76) fitted into the recess (35), the projection being formed on a second surface corresponding to the first surface, and a second bracket (94) held by the second housing (70) while facing the second surface and electrically connected to the first bracket (54). After the first housing (30) and the second housing (70) are fitted together, the projection (76) is disposed such that a side face along a direction perpendicular to the first surface faces the first bracket (54) or the second bracket (94), and the first housing (30) has a protrusion formed continuous with the first surface and located closer to the fitting side than the first bracket (54).

9 Claims, 10 Drawing Sheets

(58) Field of Classification Search
USPC ..... 439/357
See application file for complete search history.

(56) References Cited

U.S. PATENT DOCUMENTS

| | | | | |
|---|---|---|---|---|
| 8,272,881 | B2 | 9/2012 | Miyazaki | |
| 9,590,327 | B2 * | 3/2017 | Matsuno | H01R 12/7005 |
| 9,899,771 | B2 * | 2/2018 | Ashibu | H01R 12/716 |
| 9,985,366 | B2 * | 5/2018 | Takeuchi | H01R 12/00 |
| 2006/0264075 | A1 * | 11/2006 | Obikane | H01R 24/60 439/74 |
| 2015/0140841 | A1 * | 5/2015 | Watanabe | H01R 43/18 439/74 |
| 2015/0207248 | A1 * | 7/2015 | Takenaga | H01R 13/6582 439/74 |
| 2015/0270641 | A1 * | 9/2015 | Omodachi | H01R 13/629 439/374 |
| 2018/0198241 | A1 * | 7/2018 | Ooi | H01R 13/6471 |
| 2019/0173233 | A1 * | 6/2019 | Horino | H01R 12/73 |
| 2019/0190209 | A1 * | 6/2019 | Horino | H01R 12/716 |
| 2019/0319398 | A1 * | 10/2019 | Ashibu | H01R 13/405 |
| 2020/0091654 | A1 * | 3/2020 | Miyamoto | H01R 12/71 |
| 2020/0136284 | A1 * | 4/2020 | Meng | H01R 12/716 |

FOREIGN PATENT DOCUMENTS

| | | | | |
|---|---|---|---|---|
| JP | 2010225401 | A | 10/2010 | |
| JP | 5920565 | B2 | 4/2016 | |
| KR | 101176880 | B1 | 9/2012 | |
| WO | WO-2017188054 | A1 * | 11/2017 | H01R 12/71 |

* cited by examiner

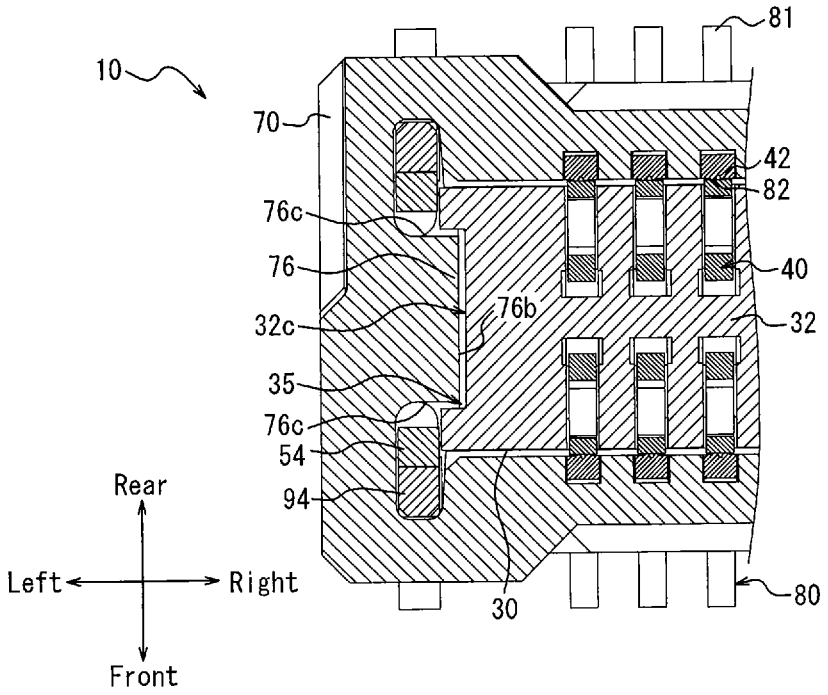
FIG. 9
FIG. 10
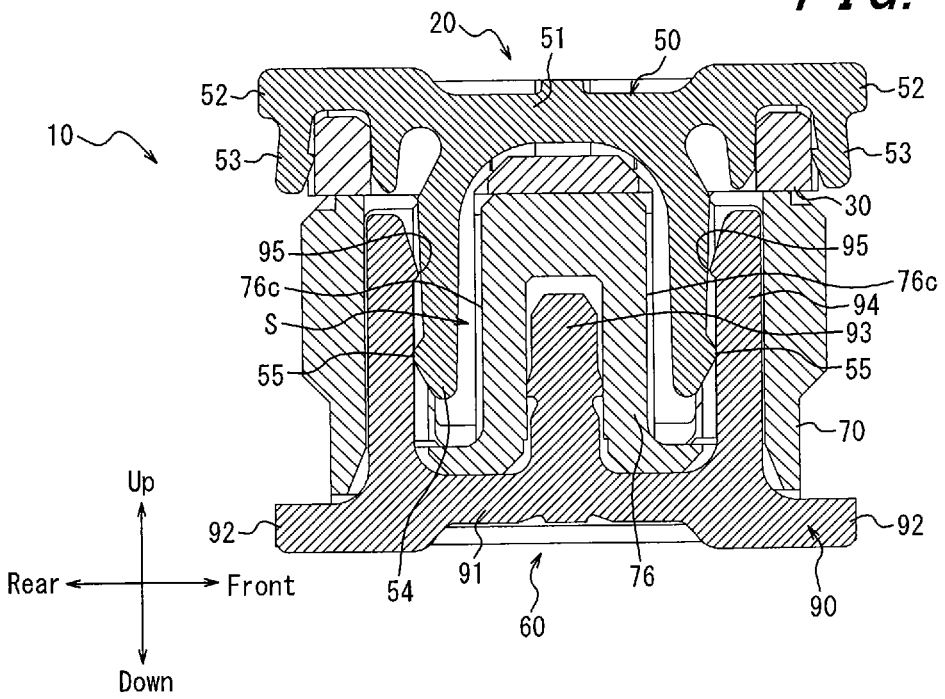

ELECTRIC CONNECTOR

CROSS-REFERENCE TO RELATED APPLICATION

This application claims priority to and the benefit of Japanese Patent Application No. 2017-105959 filed on May 29, 2017, the entire contents of which are incorporated herein by reference.

TECHNICAL FIELD

The present disclosure relates to electric connectors.

BACKGROUND

A known connector electrically connects circuit boards to each other. Patent Literature 1 (PTL 1) discloses a board to board connector that can avoid cost up or difficulty in assembly and contribute to reduction in size and height.

CITATION LIST

Patent Literature

PTL 1: JP2006-012625 (A)

SUMMARY

Technical Problem

In the above described connector, when a plug and a receptacle are fitted to each other, due to misalignment therebetween, brackets held respectively by the plug and the receptacle are deformed or a corresponding housing is scraped by the other. On the other hand, with the recent progressive miniaturization of electronic devices, an area of a circuit board in an electronic device is also decreased, and as a consequence thereof miniaturization of a connector itself mounted on a circuit board is also required.

It is therefore an object of the present disclosure to provide an electric connector capable of preventing damage to a housing and deformation of a bracket even in miniaturization.

Solution to Problem

An electric connector according to a first aspect includes a first connector and a second connector fitted with the first connector, the first connector having: a first housing with a recess formed in a first surface; and a first bracket held by the first housing while facing the first surface; and the second connector having: a second housing with a projection fitted into the recess, the projection being formed on a second surface corresponding to the first surface; and a second bracket held by the second housing while facing the second surface and electrically connected to the first bracket, wherein, after the first housing and the second housing are fitted together, the projection is disposed such that side faces along a direction perpendicular to the first surface face the first bracket or the second bracket; and the first housing has a protrusion formed continuous with the first surface and located closer to a fitting side than the first bracket.

In the electric connector according to a second aspect, the first bracket has a protrusion projecting in a fitting direction of the first housing and the second housing while facing the first surface; and the protrusion may be exposed to an outside of the first housing.

In the electric connector according to a third aspect, the protrusion may be provided in a branched manner while facing the first surface.

In the electric connector according to a fourth aspect, the protrusion has a pair of contact portions provided at branched portions so as to project in a direction parallel to the first surface, and the first housing may not be interposed between a pair of the contact portions.

In the electric connector according to a fifth aspect, in a side view from a direction perpendicular to the first surface, the recess may be located between the branched portions.

In the electric connector according to a sixth aspect, the protrusion may be elastically deformed in a direction parallel to the first surface.

In the electric connector according to a seventh aspect, the first connector has a plurality of contacts held by the first housing; the first surface is an outer surface perpendicular to a surface on which the contacts are arranged; and the recess may be provided in the first surface along an arrangement direction of the contacts.

In the electric connector according to an eighth aspect, the projection may be formed so as to correspond to a shape of the recess.

Advantageous Effect

In an electric connector according to an embodiment of the present disclosure, damage to a housing and deformation of a bracket can be prevented even in miniaturization.

BRIEF DESCRIPTION OF THE DRAWINGS

In the accompanying drawings:

FIG. 9 is an enlarged cross-sectional view along IX-IX arrow line in FIG. 8;

FIG. 10 is a cross-sectional view along X-X arrow line in FIG. 8; and

DETAILED DESCRIPTION

Hereinafter, an embodiment of the present disclosure will be described with reference to the accompanying drawings.

In the following description, a front-rear direction, a right-left direction and an up-down direction are based on the directions of the arrows in the figures. In the following description, a first connector 20 is a receptacle connector and a second connector 60 is a plug connector. However, this is not restrictive, and the first connector 20 may act as a plug connector and the second connector 60 may act as a receptacle connector.

In the following description, the first connector 20 and the second connector 60 are fitted together in the vertical direction with respect to the circuit boards CB1 and CG2, respectively. The first connector 20 and the second connector 60 are fitted together along the up-down direction. However, this is not restrictive, and the first connector 20 and the second connector 60 may be fitted in a parallel direction with respect to the circuit boards CB1 and CB2, respectively, or may be fitted in a combination of a vertical direction for one of them and a parallel direction for the other. The first connector 20 or the second connector 60 may be connected to a circuit board other than a rigid circuit board, for example, a flexible print circuit board (FPC).

Figure 1:
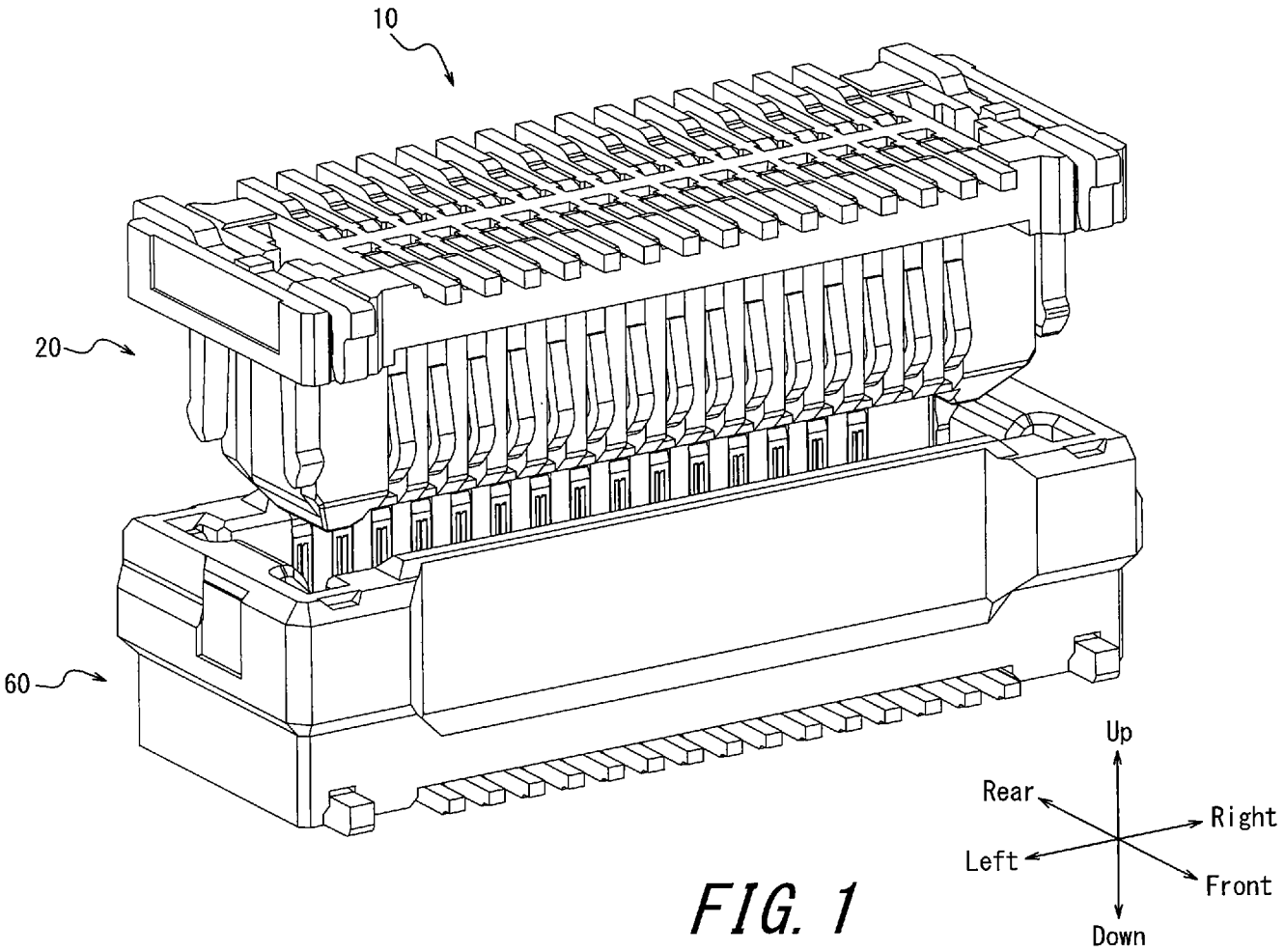
FIG. 1 is a top perspective view illustrating an electric connector according to an embodiment in a state where a first connector and a second connector are separated.

FIG. 1 is a top perspective view illustrating an electric connector 10 according to an embodiment in a state where the first connector 20 and the second connector 60 are separated.

The electric connector 10 according to an embodiment has the first connector 20 and the second connector 60 as large components.

Figure 2:
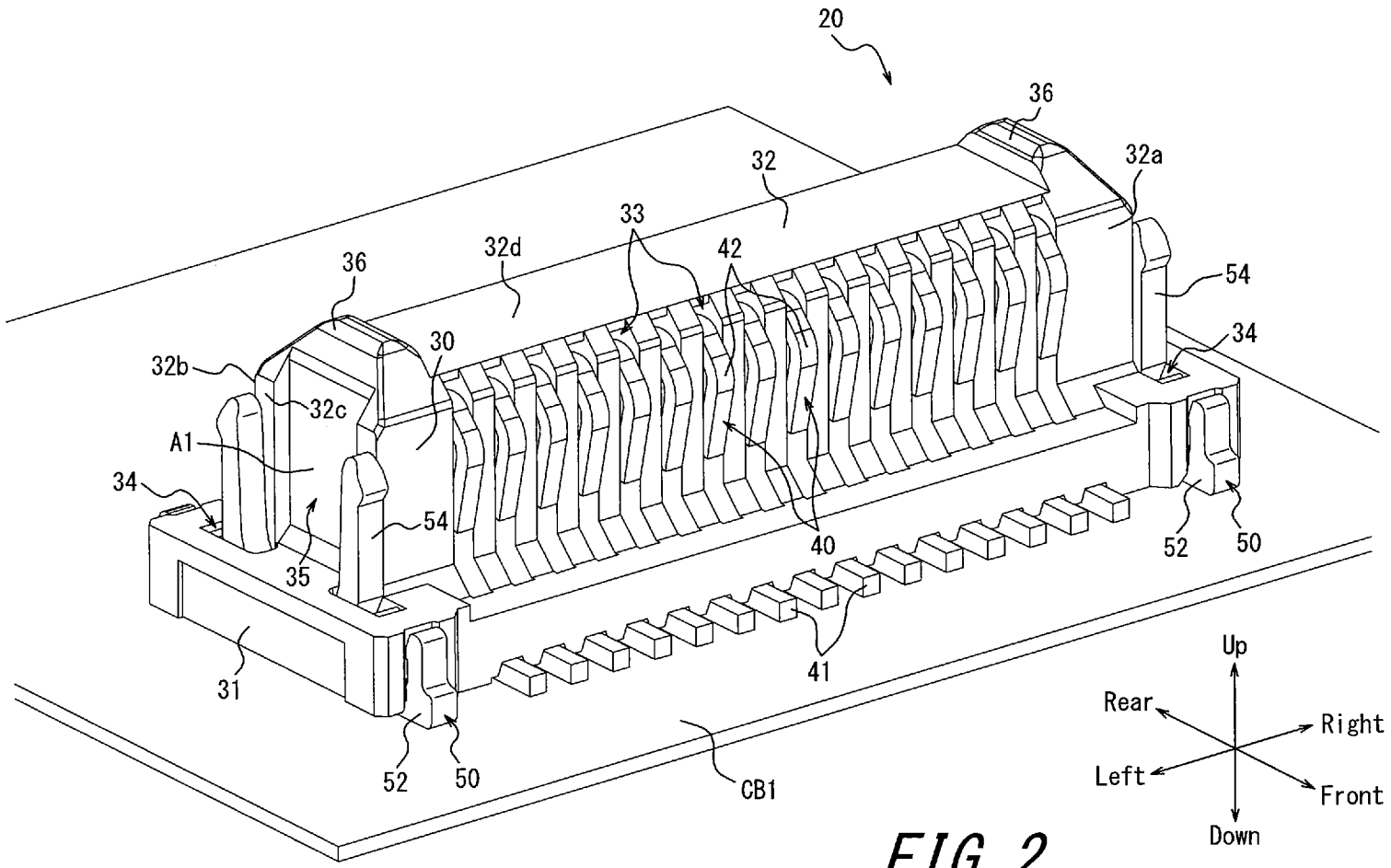
FIG. 2 is a top perspective view illustrating the first connector alone.
Figure 3:
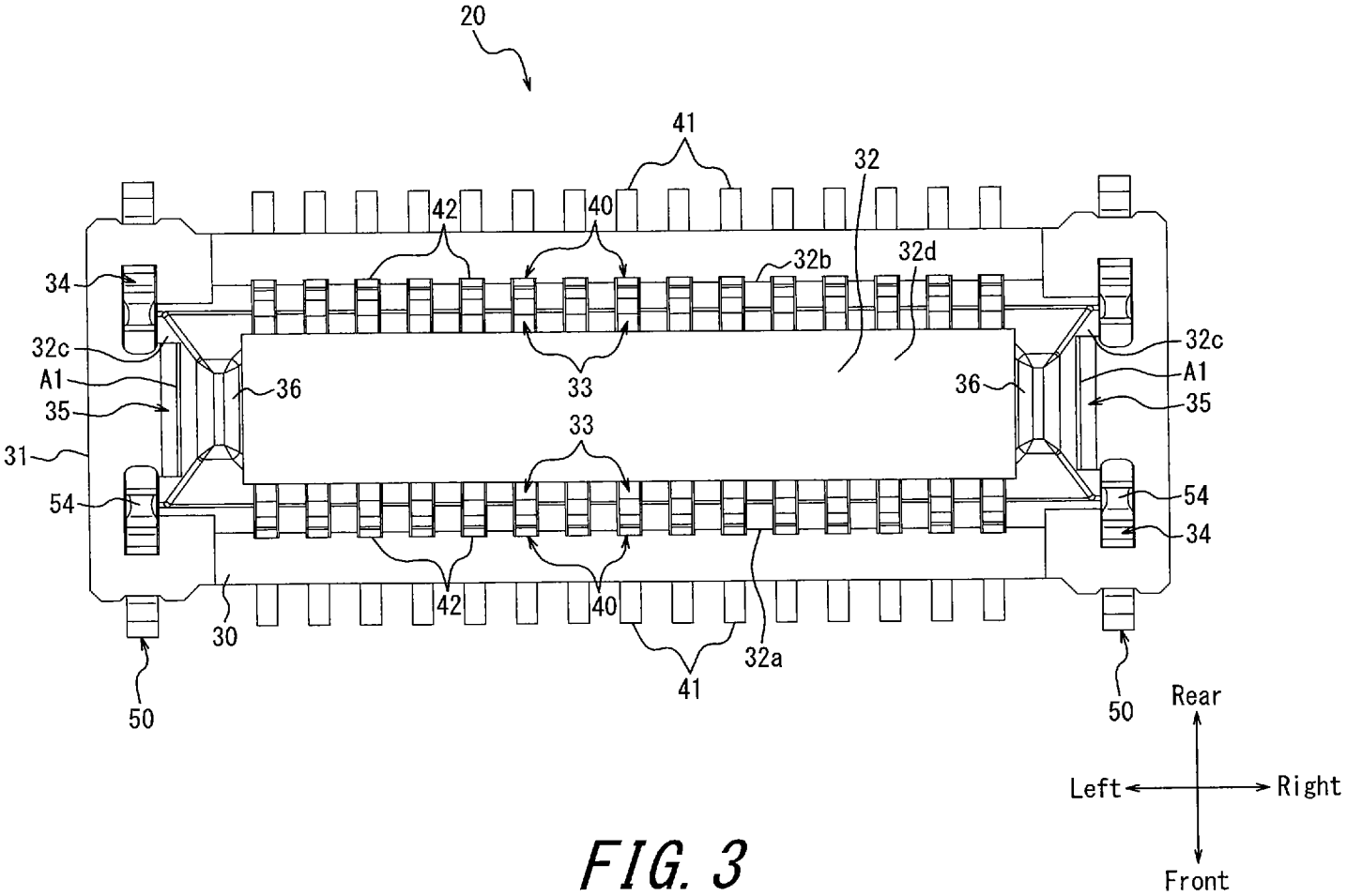
FIG. 3 is a top view illustrating the first connector alone.
Figure 4:
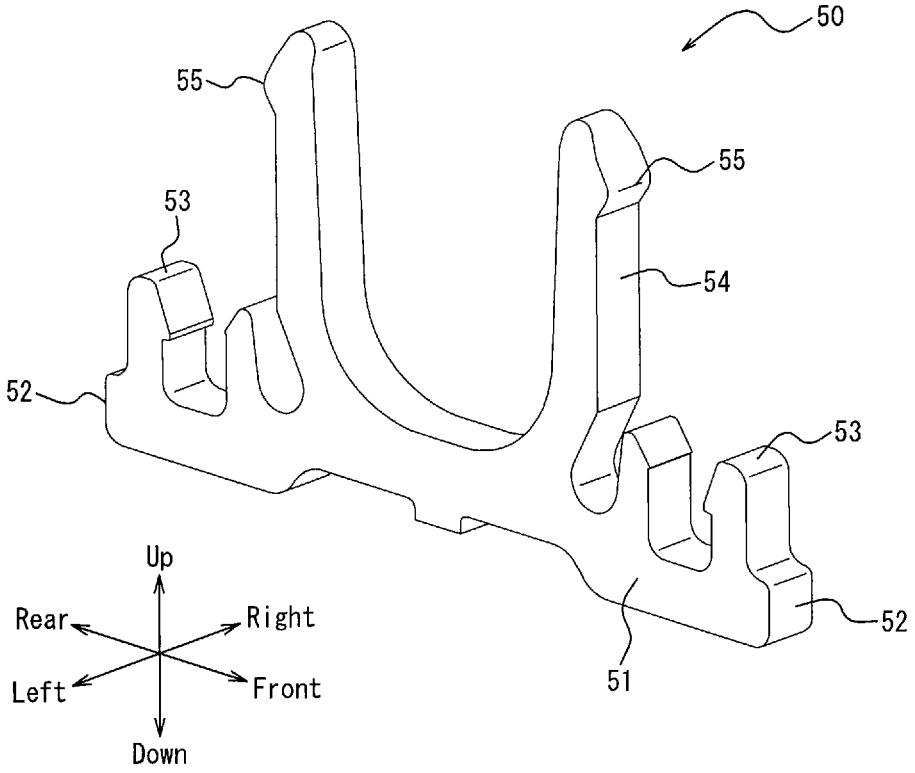
FIG. 4 is a top perspective view illustrating a first bracket to be held by the first connector.

FIG. 2 is a top perspective view illustrating the first connector 20 alone, FIG. 3 is a top view illustrating the first connector alone, and FIG. 4 is a top perspective view illustrating a first bracket 50 to be held by the first connector 20.

Detailed structure of the first connector 20 will be described mainly with reference to FIGS. 2 to 4.

As illustrated in FIG. 2, the first connector 20 includes a first housing 30 as a large component, a plurality of first contacts 40 (contacts) and two first brackets.

A first housing 30 is molded of an insulating and heat resistant synthetic resin material, and extends in the right-left direction. The first housing 30 includes a bottom plate 31 constituting a bottom and a fitting projection 32 projecting upward from the upper central portion of the bottom plate 31.

In the front wall 32*a* and the rear wall 32*b* of the fitting projection 32 and the bottom plate 31, a plurality of first contact holding grooves 33 along the up-down direction are provided side by side in a recessed manner in the right-left direction. A plurality of first contacts 40 are held by respective first contact holding grooves 33. The number of the first contact holding grooves 33 is the same as that of the first contacts 40.

First bracket holding grooves 34 are provided passing through right and left sides of the bottom plate 31, respectively. A pair of first brackets 50 are held by a pair of first bracket holding grooves 34, respectively.

A recess 35 is formed in an outer surface A1 (a first surface) of a side wall 32*c* of the fitting projection 32. The outer surface A1 is perpendicular to a surface on which the first contacts 40 are arranged, that is, to an outer surface of the front wall 32*a* and the rear wall 32*b* of the fitting projection 32. A pair of recesses 35 are formed on the right and left side walls 32*c*. Each recess 35 is provided in the outer surface A1 of the fitting projection 32 along an arrangement direction of the first contacts 40, that is, along the right-left direction.

The first housing 30 has protrusions 36 formed on the upper end of the side walls 32*c* of the fitting projection 32. Each protrusion 36 is continuous with the outer surface A1 of the side wall 32*c* of the fitting projection 32, and is provided on a top surface 32*d* of the fitting projection 32. Each protrusion 36 guides the first housing 30 to the second housing 70 when they are fitted together. Each protrusion 36 is located closer to the fitting side than the first bracket 50, that is, located on the upper side. Each protrusion 36 has a slope tapered toward the fitting side. As illustrated in FIG. 2, four side faces each located on the front, rear, right and left of the protrusion 36 are formed as slopes to allow the protrusion 36 to become tapered. In this manner, each protrusion 36 is formed into a tapered shape in which the front-rear width and the right-left width are decreased upward.

First contacts 40 are formed by processing of a thin plate made of a copper alloy (e.g. phosphor bronze, beryllium copper or titanium copper) or Corson copper alloy by using a progressive die (stamping). First contacts 40 are plated with gold or tin after nickel plate undercoating.

First contacts 40 include mounting portions 41 each formed on the lower end and extending outward along the front-rear direction. First contacts 40 include first contact portions 42 each formed on the upper portion and facing outward along the front-rear direction.

First contacts 40 are held by first contact holding grooves 33 by being press-fitted therein. Mounting portions 41 of the first contacts 40 are disposed such that they project outward from the lower end of the bottom plate 31 along the front-rear direction with the first contacts 40 held by the first housing 30 (first contact holding grooves 33). In the same state, first contact portions 42 of the first contacts 40 are disposed such that they project outward from the outer surface of the front wall 32*a* and the rear wall 32*b* of the fitting projection 32 along the front-rear direction.

The first bracket 50 is molded into a shape as illustrated in FIG. 4 by using a progressive die (stamping). The first bracket 50 includes a base 51 extending in the right-left direction and mounting portions 52 formed on both ends of the base 51 and extending outward. The first bracket 50 includes holding portions 53 provided in a branched manner, each holding portion 53 projecting upward from the upper end of each mounting portion 52. The first bracket 50 includes a protrusion 54 provided in a branched manner, the protrusion 54 projecting upward from the central portion of the base 51. The first bracket 50 includes second contact portions 55 extending outward in the front-rear direction, on the upper ends of the protrusion 54.

The first bracket 50 is held by the first bracket holding grooves 34 by being press fitted therein (see FIG. 2). The first bracket 50 is held by the first bracket holding grooves 34 when a part of the first housing 30 is clamped between the holding portions 53. With the first bracket 50 held by the first housing 30 (the first bracket holding grooves 34), branched portions of the protrusion 54 of the first bracket 50 project in the up-down direction (fitting direction) while facing the outer surface A1 of the side wall 32*c* of the fitting projection 32. In the same state, the branched portions of the protrusion 54 are exposed to the outside of the first housing 30. The branched portions of the protrusion 54 are disposed while facing the outer surface A1 of the side wall 32*c* of the fitting projection 32, and no first housing 30 is interposed between a pair of second contact portions 55 formed on the branched portions of the protrusion 54. In the same state, a pair of second contact portions 55 are provided on the branched portions of the protrusion 54 so as to project in a direction parallel to the outer surface A1, that is, in the front-rear direction. The branched portions of the protrusion 54 are elastically deformed in a direction parallel to the outer surface A1, that is, in the front-rear direction.

With the first bracket 50 held by the first housing 30 (first bracket holding grooves 34), the branched portions of the protrusion 54 are disposed such that the recess 35 is placed therebetween, in a side view in the right-left direction. The branched portions of the protrusion 54 are disposed close to the outer surface A1 of the side wall 32*c* of the fitting projection 32 and the recess 35, and are exposed to the outside thereof.

In the first connector 20 configured in the above described manner, the mounting portions 41 of the first contacts 40 are soldered to a circuit pattern formed on a mounting surface of a circuit board CB1. The mounting portions 52 of the first bracket 50 are soldered to a ground pattern formed on the mounting surface. In this manner, the first connector 20 is mounted on the circuit board CB1. An electronic component (e.g. a CPU, a controller, a memory, etc.) different from the first connector 20 is mounted on the mounting surface of the circuit board CB1.

The detailed structure of the second connector 60 will be described with reference mainly to FIGS. 5 to 7.

Figure 5:
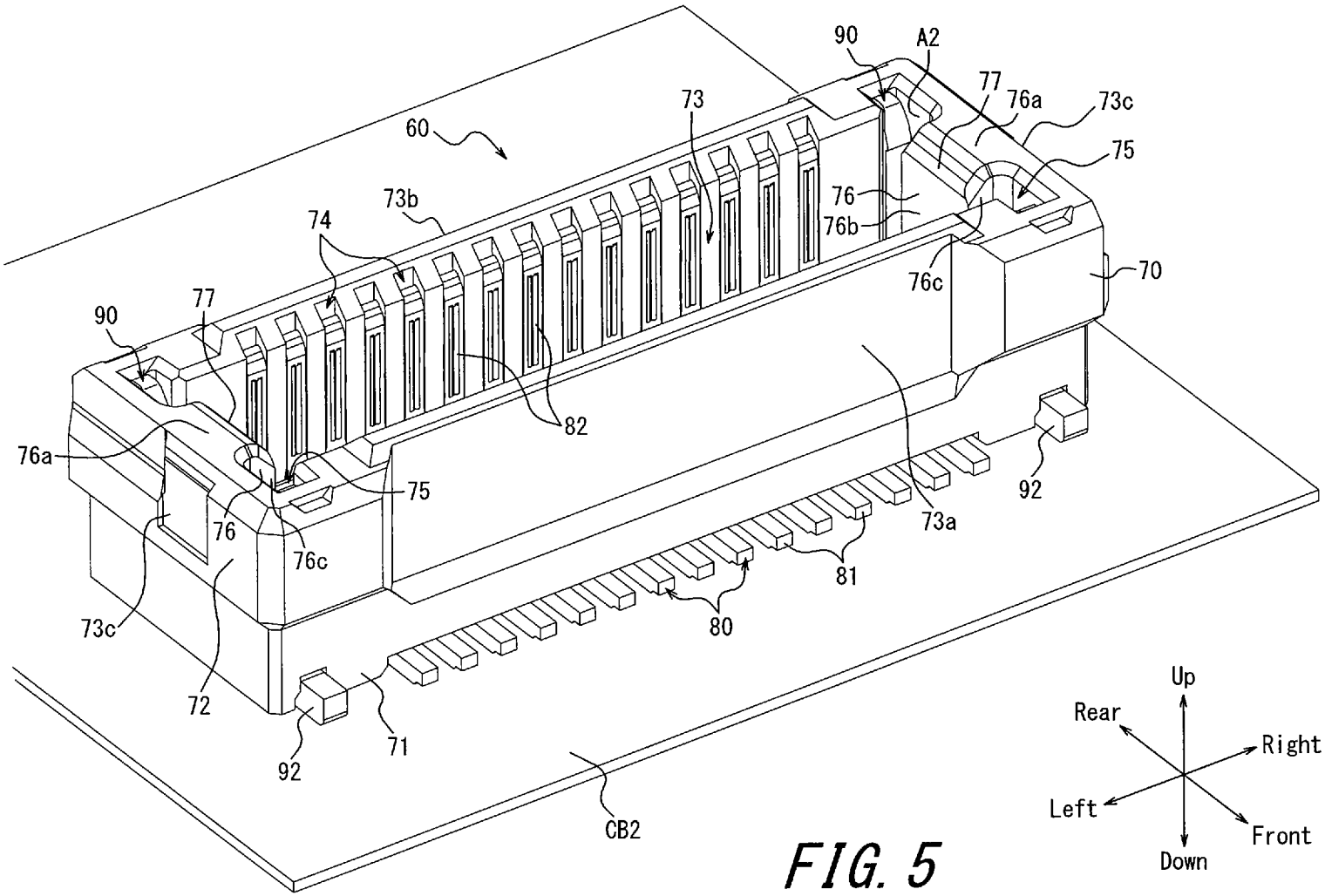
FIG. 5 is a top perspective view illustrating the second connector alone.
Figure 6:
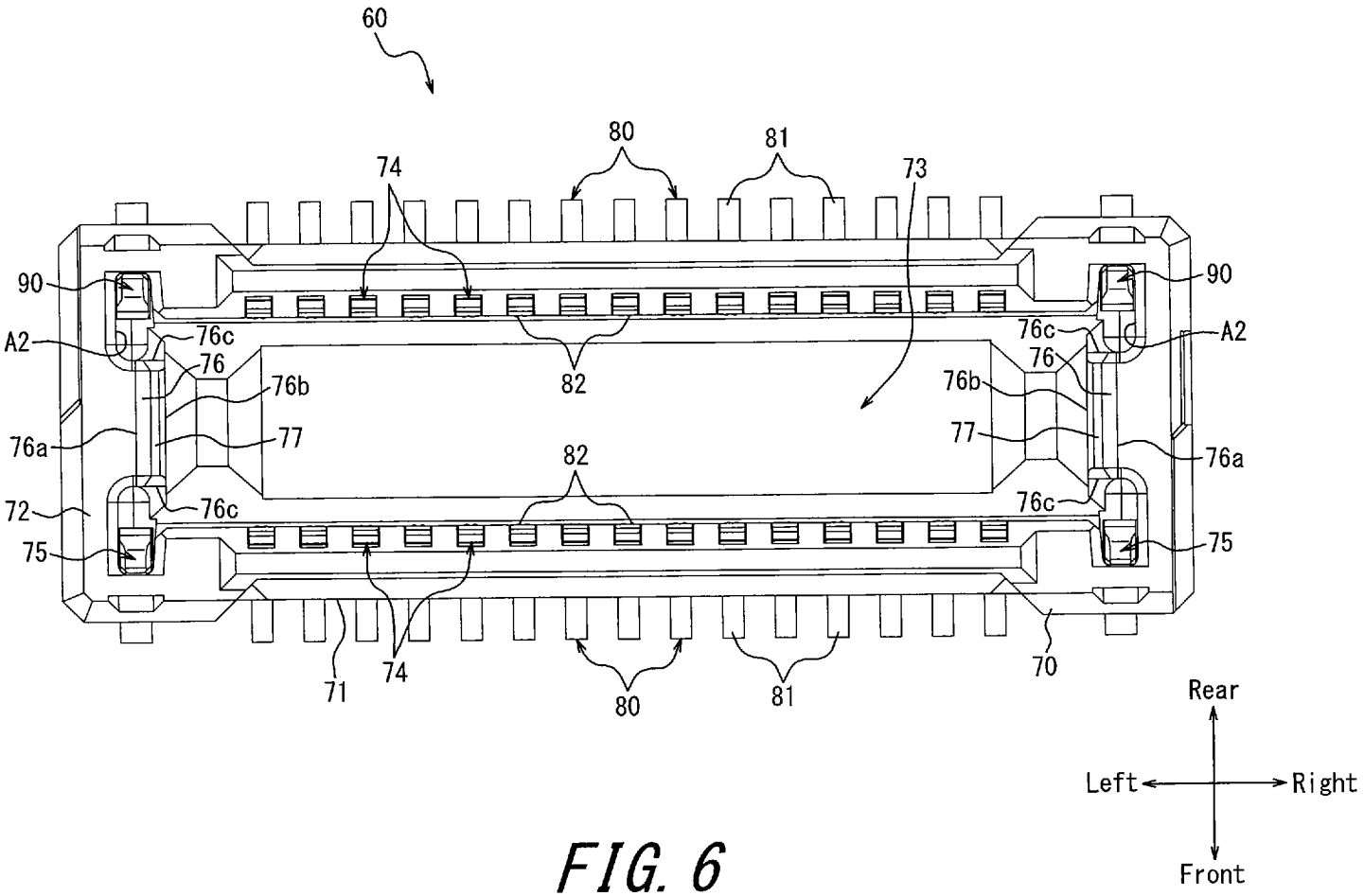
FIG. 6 is a top view illustrating the second connector alone.
Figure 7:
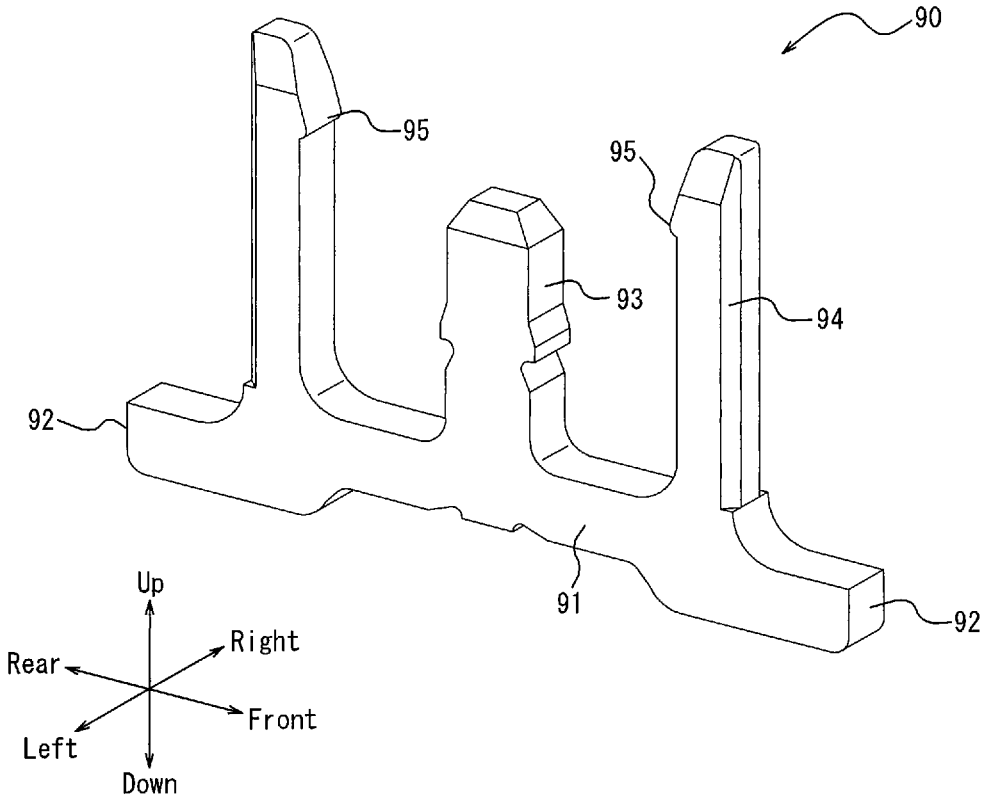
FIG. 7 is a top perspective view illustrating a second bracket to be held by the second connector.

FIG. 5 is a top perspective view illustrating the second connector 60 alone, FIG. 6 is a top view illustrating the second connector 60 alone, and FIG. 7 is a top perspective view illustrating a second bracket 90 to be held by the second connector 60.

As illustrated in FIG. 5, the second connector 60 includes a second housing 70 as a large component, and a plurality of second contacts 80 and two second brackets 90.

The second housing 70 is a member extending in the right-left direction obtained through injection molding of an insulating and heat resistant synthetic resin material (see FIG. 5). The second housing 70 includes a bottom plate 71 constituting a bottom and an annular outer peripheral wall 72 projecting upward from an outer circumferential edge of a top surface of the bottom plate 71. The space formed in the annular outer peripheral wall 72 constitutes a fitting recess 73.

In the front wall 73*a* and the rear wall 73*b* of the fitting recess 73 and the bottom plate 71, a plurality of second contact holding grooves 74 along the up-down direction are recessed side by side in the right-left direction. A plurality of second contacts 80 are held by a plurality of second contact holding grooves 74. The number of the second contact holding grooves 74 is the same as that of the second contacts 80.

Second bracket holding grooves 75 are recessed on the right and left ends of the fitting recess 73, respectively. A pair of second brackets 90 are held by a pair of second bracket holding grooves 75, respectively.

A projection 76 is formed on an inner surface A2 (a second surface) of a side wall 73*c* of the fitting recess 73. A pair of projections 76 are formed on the right and left side walls 73*c*. Each projection 76 is provided on the inner surface A2 of the fitting recess 73 so as to project in the arrangement direction of the second contacts 80, that is, along the right-left direction. Each projection 76 may be formed so as to correspond to the shape of the recess 35. The front-rear width of the projection 76 may be slightly smaller than that of the recess 35.

R-shaped guide portions 77 with an appropriate curvature are formed respectively at ends, that is, upper ends on the fitting side of the projection 76. Each guide portion 77 is formed into a substantial arc shape extending from the upper end surface 76*a* of the projection 76 to the side face 76*b* parallel to the side wall 73*c* of the fitting recess 73. Each guide portion 77 may be formed by a slope, which enables the guide portion 77 to be formed easily.

Second contacts 80 are formed by processing of a thin plate made of a copper alloy (e.g. phosphor bronze, beryllium copper or titanium copper) or Corson copper alloy by using a progressive die (stamping). Second contacts 80 are plated with gold or tin after nickel plate undercoating.

Second contacts 80 include mounting portions 81 each formed on the lower end and extending outward along the front-rear direction. Second contacts 80 include third contact portions 82 each formed on the upper portion and facing inward along the front-rear direction. Each third contact portion 82 extends over a predetermined area along the up-down direction.

Second contacts 80 are held by second contact holding grooves 74 by being press-fitted therein. Mounting portions 81 of the second contacts 80 are disposed such that they project outward from the lower end of the bottom plate 71 along the front-rear direction with the second contacts 80 held by the second housing 70 (second contact holding grooves 74). In the same state, third contact portions 82 of the second contacts 80 are disposed such that they face inward on the inner surface of the front wall 73*a* and the rear wall 73*b* of the fitting recess 73 along the front-rear direction The second bracket 90 is molded into a shape as illustrated in FIG. 7 by using a progressive die (stamping). The second bracket 90 includes a base 91 extending in the right-left direction and mounting portions 92 formed on both ends of the base 91 and extending outward. The second bracket 90 includes a holding portion 93 projecting upward from the central portion of the base 91. The second bracket 90 includes a protrusion 94 provided in a branch manner projecting upward from the base 91 with the holding portion 93 placed between the branched portions of the protrusion 94. The second bracket 90 includes protruding portions 95 protruding inward in the front-rear direction on the upper ends of the branched portions of the protrusion 94.

The second bracket 90 is held by the second bracket holding grooves 75 by being press-fitted therein (see FIG. 5). The second bracket 90 is held by the second bracket holding grooves 75 when the holding portion 93 is press fitted into a part of the second bracket holding groove 75. With the second bracket 90 held by the second housing 70 (the second bracket holding grooves 75), the holding portion 93 is located in the projection 76 formed on the inner surface A2 of the side wall 73*c* of the fitting recess 73. In the same state, the branched portions of the protrusion 94 of the second bracket 90 project in the up-down direction (the fitting direction) while facing the inner surface A2 of the side wall 73*c* of the fitting recess 73. The projection 76 is disposed between the branched portions of the protrusion 94. In this manner, the second bracket 90 is held by the second housing 70 with the projection 76 clamped.

The second connector 60 configured in the above described manner is mounted on a mounting surface formed on one surface of a circuit board CB2, which is a plate parallel to the circuit board CB1. Specifically, the mounting portions 81 of the second contacts 80 are soldered to a circuit pattern formed on the mounting surface of the circuit board CB2. The mounting portions 92 of the second bracket 90 are soldered to a ground pattern or the like formed on the mounting surface. In this manner, the second connector 60 is mounted on the circuit board CB2. An electronic component (e.g. a high function module, a semiconductor, a CPU, a controller, a high-capacity memory, etc.) different from the second connector 60 is mounted on the mounting surface of the circuit board CB2.

The procedure of connecting the second connector 60 to the first connector 20 will be described below.

Figure 8:
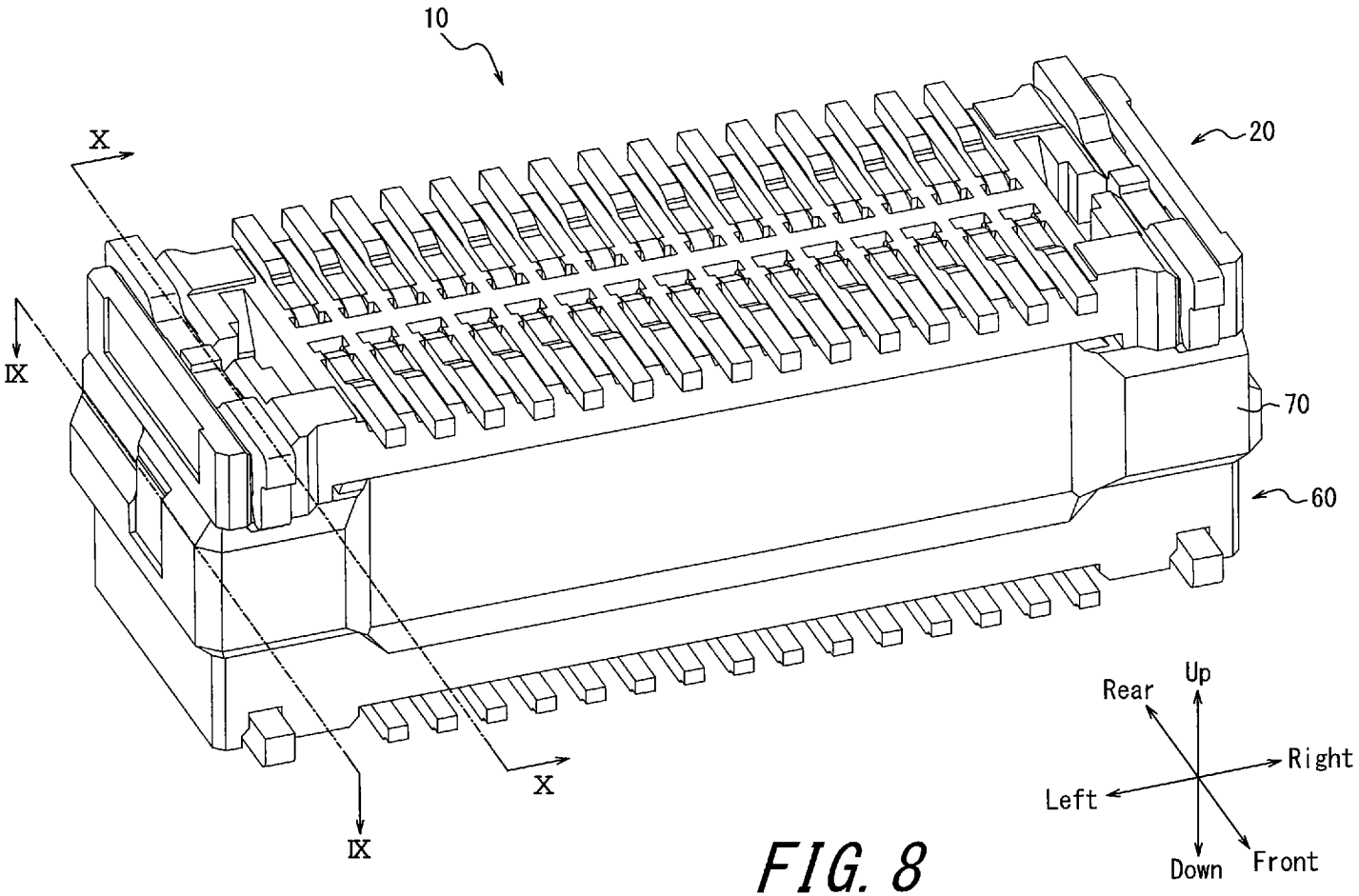
FIG. 8 is a top perspective view illustrating the electric connector in a state where the first connector and the second connector are fitted together.

FIG. 8 is a top perspective view illustrating the electric connector 10 in a state where the first connector 20 and the second connector 60 are fitted together, FIG. 9 is an enlarged cross-sectional view along IX-IX arrow line in FIG. 8, and FIG. 10 is a cross-sectional view along X-X arrow line in FIG. 8.

As illustrated in FIG. 1, with the first connector 20 upside down, the first connector 20 and the second connector 60 are faced to each other in the up-down direction while the front-rear position and the right-left position thereof are substantially aligned. The first connector 20 is displaced downward. At this time, even if they are misaligned slightly in the front-rear or right-left direction, for example, the protrusions 36 of the first connector 20 are provided on the top surface 32*d* of the fitting projections 32 as described above. Thus the protrusions 36 come in contact with the second connector 60 first. Since each protrusion 36 is formed as a slope that inclines as it closes to the fitting side, it acts to guide the first housing 30 from the time when it first comes in contact with the second connector 60, more specifically, with the second housing 70. Even if the first connector 20 and the second connector 60 are slightly misaligned to each other in the front-rear or right-left direction, the first connector 20 is guided, by the protrusions 36, to the most appropriate position where the first connector 20 is fitted into the second connector 60. The first connector 20 guided by the protrusions 36 is further guided into the fitting recess 73 by the R-shaped guide portions 77 each provided to the end on the fitting side of each projection 76 of the second connector 60. In this case, the position of the first connector 20 in the front-rear direction is determined with reference to the front wall 73*a* and the rear wall 73*b* of the fitting recess 73 of the second connector 60.

When the first connector 20 is displaced further downward, the second contact portions 55 of the first bracket 50 come in contact with the protruding portions 95 of the second bracket 90, and the branched portions of the protrusion 54 are slightly elastically deformed inward. At the same time as the branched portions of the protrusion 54 are slightly elastically deformed inward, the second contact portions 55 slide downward relative to the protruding portions 95. When the second contact portions 55 climb over the protruding portions 95, the elastic deformation of the branched portions of the protrusion 54 is slightly mitigated. In this state the second contact portions 55 slide the inner surfaces of the branched portions of the protrusion 94 of the second bracket 90.

When the first connector 20 is displaced further downward and the fitting projection 32 completely enters into the fitting recess 73 of the second connector 60, the first connector 20 and the second connector 60 are fitted to each other. The first bracket 50 and the second bracket 90 are engaged with each other. In this state, the first contact portions 42 of the first contacts 40 and the third contact portions 82 of the second contacts 80 come in contact with each other. First contacts 40 are slightly elastically deformed inward near the first contact portions 42 by the vertical drag from the third contact portions 82 caused by contact with the first contact portions 42. In the same state, the second contact portions 55 of the first bracket 50 come in contact with the second bracket 90 (see FIG. 10). In the first bracket 50, the branched portions of the protrusion 54 are slightly elastically deformed inward by the vertical drag from the second bracket 90 caused by contact with the second contact portions 55. The distance between the branched portions of the protrusion 54 is slightly decreased compared to that in the free state where no external force is applied.

In this manner, the first connector 20 and the second connector 60 are completely connected to each other. The first contacts 40 and the second contacts 80 are electrically connected to each other and the first brackets 50 and the second brackets 90 are electrically connected to each other. This enables the circuit board CB1 and the circuit board CB2 to be electrically conductible through the first contacts 40, the second contacts 80 and the like.

In this case, as illustrated in FIG. 9, the projection 76 of the second housing 70 is fitted into the recess 35 of the first housing 30. The projection 76 is disposed close to the first bracket 50 in an elastic deformation direction of the first bracket 50 engaged with the second bracket 90, that its, in the front-rear direction. The projection 76 is disposed in the direction perpendicular to the outer surface A1, that is, disposed such that the side face 76*c* along the right-left direction faces the first bracket 50. The projection 76 is clamped by the first bracket 50 engaged with the second bracket 90. More specifically, the branched portions of the protrusion 54 of the first bracket 50 are clamped between the branched portions of the protrusion 94 of the second bracket 90 in the front-rear direction, and the projection 76 of the second housing 70 is clamped between the branched portions of the protrusion 54 of the first bracket 50 along the front-rear direction. In this manner, the projection 76 is disposed so as to project into the recess 35 side beyond the first bracket 50 in the right-left direction. More specifically, when fitted to each other, the side face 76*b* of the projection 76 facing the side wall 32*c* of the fitting projection 32 of the first housing 30 is located on the recess 35 side beyond the protrusion 94 and the protrusion 54 in the right-left direction. The projection 76 is fitted into the recess 35 in a state where the fitting face in the right-left direction projects to the inside of the first bracket 50 and the second bracket 90.

As illustrated in FIG. 10, after the first housing 30 and the second housing 70 are fitted together, a space S is formed between the protrusion 54 of the first bracket 50 and the projection 76. The protrusion 54 of the first bracket 50 does not come in contact with the projection 76 of the second housing 70 even if it is slightly elastically deformed and is engaged with the second bracket 90. An extra space that allows for further elastic deformation of the branched portions of the protrusion 54 is formed between the protrusion 54 formed in a branched manner and the projection 76, whereas the protrusion 54 and the projection 76 come close to each other. The protrusion 54 and the projection 76 come close to each other to the degree that allows an excess elastic deformation of the branched portions of the protrusion 54 to be suppressed. In this case, when the first housing 30 and the second housing 70 are fitted together, even if the first bracket 50 is slightly elastically deformed when they are obliquely fitted, the protrusion 54 and the projection 76 are close to each other to the degree that allows the projection 76 to support the first bracket 50.

Because of the first bracket 50 and the projection 76 disposed close to each other and the configuration of each protrusion 36, the electric connector 10 configured in the above described manner can prevent a housing from being damaged and a bracket from being excessively deformed in miniaturization. Since an excessive elastic deformation of the first bracket 50 can be suppressed by the projection 76, the electric connector 10 can reduce the possibility of excessive deformation of the first bracket 50 when fitted together. For example, when the first housing 30 and the second housing 70 are fitted together, even if the first bracket 50 is slightly elastically deformed in a state where they are obliquely fitted, the projection 76 formed on the second housing 70 supports the first bracket 50. Therefore, the electric connector 10 can prevent the first bracket 50 from being excessively deformed. Since the protrusion 36 of the first housing 30 is located closer to the fitting side than the first bracket 50, the electric connector 10 can appropriately protect the bracket and housing when fitted together. Even if the first connector 20 and the second connector 60 are slightly misaligned in the right-left direction or the right-left direction, the portion that comes in contact with the second connector 60 first is the protrusion 36. In this manner, the electric connector 10 comes in contact with a portion of the second connector 60 before the first bracket 50 is inserted into an appropriate position when fitted together and consequently excessive deformation of the bracket or damage to the housing can be prevented.

When the projection 76 is fitted into the recess 35, the first connector 20 and the second connector 60 are guided to each other during fitting. Therefore, in the electric connector 10, the first connector 20 and the second connector 60 are fitted easily. In the same manner, fitting of the projection 76 into the recess 35 facilitates positioning of one of the first connector 20 and the second connector 60 to the other.

In the electric connector 10, a fitting force of the first connector 20 and the second connector 60 can be improved by the fitting structure of the projection 76 and the recess 35. In this manner, even if the electric connector 10 is miniaturized, a fitting force can be improved. In the electric connector 10, engagement between the first bracket 50 and the second bracket 90 can strengthen the connection between the first connector 20 and the second connector 60.

In the electric connector 10, the protrusion 54 of the first bracket 50 is exposed to the outside of the first housing 30. Thus it is not required for the first housing 30 to cover a corresponding portion, and thus miniaturization of the first connector 20 can be achieved. In the electric connector 10, the first connector 20 can be miniaturized in the arrangement direction of the first contacts 40, that is, in the right-left direction. The first connector 20 reduces the area it occupies on the circuit board CB1, and thus can contribute to an overall space-saving of the circuit board CB1.

In the electric connector 10, the protrusion 54 is formed in a branched manner, which allows for a certain degree of elastic deformation of the first bracket 50. In the electric connector 10, since no first housing 30 is interposed between the branched portions of the protrusion 54, the first connector 20 can be further miniaturized. In the electric connector 10, the amount of elastic deformation of the protrusion 54 of the first bracket 50 to inside can be secured during fitting. Therefore, even in a miniaturized state, an engaging force between the first bracket 50 and the second bracket 90 is improved.

In the electric connector 10, the first connector 20 can be miniaturized in the right-left direction by allowing the second contact portions 55 of the first bracket 50 to turn in the front-rear direction. The second contact portions 55 of the first bracket 50 are provided at the branched portions of the protrusion 54 along the front-rear direction, and the branched portions of the protrusion 54 are elastically deformed in the front-rear direction when engaged with the second bracket 90, thus it is not required to provide a space for elastic deformation of the first bracket 50 in the right-left direction. On the other hand, since the recess 35 is located between the branched portions of each protrusion 54, the electric connector 10 can secure a space for elastic deformation of the first bracket 50 in the front-rear direction. In this manner, since the first bracket 50 and the second bracket 90 are configured to engage along the front-rear direction, the electric connector 10 can be miniaturized entirely in the right-left direction.

In the electric connector 10, a slight elastic deformation of the protrusion 54 is allowed by the space S formed between the protrusion 54 and the projection 76 after fitting. As a result, in the electric connector 10, engagement between the first bracket 50 and the second bracket 90 can be further strengthened, and a fitting force between the first connector 20 and the second connector 60 can be improved. In the electric connector 10, even in miniaturization, stable contact between the first bracket 50 and the second bracket 90 can be maintained. On the other hand, in the electric connector 10, even in miniaturization d, an excessive deformation of the bracket can be prevented owing to the arrangement of the first bracket 50 and the projection 76 disposed close to each other and the configuration of the protrusion 36. Since the excessive elastic deformation of the first bracket 50 is suppressed by the projection 76, the electric connector 10 can reduce a possibility of excessive deformation of the first bracket 50 during fitting.

In the electric connector 10, the protrusion 36 is tapered toward the fitting side, which further facilitates guiding of the first housing 30 into the second housing 70. In the electric connector 10, the slopes of the protrusion 36 come in contact with the second housing 70, which allows for conversion of a pushing force of the first connector 20 toward the fitting direction into a guiding force toward the inside of the fitting recess 73. As a result, in the electric connector 10, the first connector 20 and the second connector 60 can be fitted together more easily.

In the electric connector 10, the recess 35 is provided along the arrangement direction of the first contacts 40, that is, in the right-left direction, which facilitates positioning of the first housing 30 and the second housing 70 in the right-left direction.

In the electric connector 10, the shape of the projection 76 that corresponds to the recess 35 further facilitates guiding of the first connector 20 and the second connector 60 during fitting. In the electric connector 10, fitting between the first connector 20 and the second connector 60 is further facilitated. In the same manner, the electric connector 10 can further improve a fitting force between the first connector 20 and the second connector 60.

In the electric connector 10, the guide portion 77 is provided on the upper end of the projection 76 of the second housing 70, which further facilitates guiding of the first connector 20 during fitting. Therefore fitting between the first connector 20 and the second connector 60 is further facilitated.

In the electric connector 10, the protruding portion 95 of the second bracket 90 acts as a climbing wall of the first connector 20 in the pulling direction, and as a result a pulling action can be realized. In this manner, the electric connector 10 can improve a holding force during fitting.

It will be apparent to those skilled in the art that the present disclosure may be realized in forms other than the embodiment described above, without departing from the spirit and the fundamental characteristics of the present disclosure. Accordingly, the foregoing description is merely illustrative and not limiting in any manner. The scope of the present disclosure is defined by the appended claims, not by the foregoing description. Among all modifications, those within a range of the equivalent to the present disclosure shall be considered as being included in the present disclosure.

Figure 11:
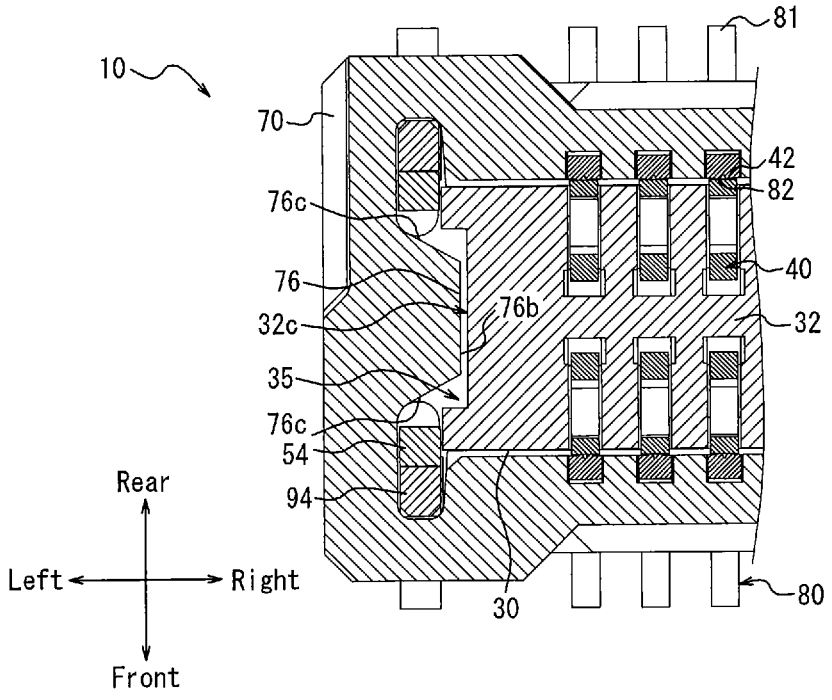
FIG. 11 is an enlarged cross-sectional view illustrating a variation of the electric connector according to an embodiment, corresponding to FIG. 9.

FIG. 11 is an enlarged cross-sectional view illustrating a variation of the electric connector according to an embodiment, corresponding to FIG. 9. For example, as illustrated in FIG. 11, the side face 76*c* of the projection 76 of the second housing 70 along the direction perpendicular to the outer surface Al, that is, along the right-left direction, may not be parallel in the right-left direction. The side face 76*c* of the projection 76 may be any slope inclined with respect to the right-left direction or may be any curved surface.

For example, the structure of the recess 35 of the first housing 30 may be replaced with the structure of the projection 76 of the second housing 70 such that the first housing 30 has a projection and the second housing 70 has a corresponding recess.

The position of the fitting surface with respect to the right-left direction of the projection 76 of the second housing 70 is not limited to the position illustrated in FIG. 9, and it may be any position as far as the projection 76 can suppress an excessive elastic deformation of the first bracket 50. For example, in FIG. 9, the fitting surface may be located on the slightly left of the respective right end surfaces of the first bracket 50 and the second bracket 90.

The positional relationship between the first bracket 50 and the second bracket 90 and the projection 76 is not limited to the relationship illustrated in FIG. 9. For example, the protrusion 54 of the first bracket 50 may be located outermost and the protrusion 94 of the second bracket 90 may be located between the protrusion 54 and the projection 76. In this case, the side face 76*c* of the projection 76 faces the second bracket 90, more specifically, the protrusion 94.

The protrusion 54 of the first bracket 50 is not limited to the state where it is exposed as illustrated in FIG. 2, and may be exposed in any manner as far as it can contribute to miniaturization of the first connector 20. For example, the first housing 30 may be interposed between the branched portions of the protrusion 54.

The first bracket 50 and the second bracket 90 are not limited to be configured to be press fitted and held by the first housing 30 and the second housing 70, respectively, and they may be held through insert molding.

The second bracket 90 is not limited to be configured to be disposed in the second housing 70 as illustrated in FIG. 5. For example, as with the first bracket 50, the second bracket 90 may be exposed to the outside of the second housing 70. In this manner, the electric connector 10 can contribute to miniaturization of not only the first connector 20 but also the second connector 60.

REFERENCE SIGNS LIST

10 electric connector
20 first connector
30 first housing
31 bottom plate
32 fitting projection
32*a* front wall
32*b* rear wall
32*c* side wall
32*d* top surface
33 first contact holding groove
34 first bracket holding groove
35 recess
36 protrusion
40 first contact (contact)
41 mounting portion
42 first contact portion
50 first bracket
51 base
52 mounting portion
53 holding portion
54 protrusion
55 second contact portion
60 second connector
70 second housing
71 bottom plate
72 outer peripheral wall
73 fitting recess
73*a* front wall
73*b* rear wall
73*c* side wall
74 second contact holding groove
75 second bracket holding groove
76 projection
76*a* upper end surface
76*b* side face
76*c* side face
77 guide portion
80 second contact
81 mounting portion
82 third contact portion
90 second bracket
91 base
92 mounting portion
93 holding portion
94 protrusion
95 protruding portion
A1 outer surface (first surface)
A2 inner surface (second surface)
S space
CB1 circuit board
CB2 circuit board

The invention claimed is:

1. An electric connector, comprising:

a first connector and a second connector fitted with each other; and a second connector configured to be fitted with said first connector, said first connector including:

a first housing including an outer surface and a recess formed in said outer surface; and a first bracket held by said first housing while facing said outer surface;

said second connector including:

a second housing including an inner surface facing said outer surface in a fitting state where said first connector and said second connector are fitted together and a projection fitted into said recess in said fitting state, said projection being formed on said inner surface; and a second bracket held by said second housing while facing said inner surface and electrically connected to said first bracket in said fitting state;

wherein, in said fitting state, said projection is disposed such that side faces along a first direction perpendicular to said outer surface face said first bracket or said second bracket; and said first bracket and said second bracket are clamped by said first housing and said second housing in a state where positions of said first bracket and said second bracket in said first direction overlap each other.

2. The electric connector according to claim 1, wherein, said first bracket has a protrusion projecting in a fitting direction of said first housing and said second housing while facing said outer surface; and said protrusion is exposed to an outside of said first housing.

3. The electric connector according to claim 2, wherein said protrusion is formed in a branched manner while facing said outer surface.

4. The electric connector according to claim 3, wherein said protrusion includes a pair of contact portions provided at branched portions of the protrusion so as to project in a second direction parallel to said outer surface; and said first housing is not interposed between a pair of said contact portions.

5. The electric connector according to claim 4, wherein, in a side view from said first direction, said recess is located between said branched portions.

6. The electric connector according to any one of claims 2 to 5, wherein said protrusion is elastically deformed in a second direction parallel to said outer surface.

7. The electric connector according to claim 1, wherein, said first connector includes a plurality of contacts held by said first housing;

said outer surface is an outer surface perpendicular to a surface on which said contacts are arranged; and said recess is provided in said outer surface along an arrangement direction of said contacts.

8. The electric connector according to claim 7, wherein said projection is formed so as to correspond to a shape of said recess.

9. The electric connector according to claim 1, wherein said first bracket and said second bracket are formed flat along a second direction parallel to said outer surface.

* * * * *